US008281609B1

(12) United States Patent
Rothschild et al.

(10) Patent No.: US 8,281,609 B1
(45) Date of Patent: Oct. 9, 2012

(54) MAN PORTABLE MICRO-CLIMATE

(76) Inventors: Jesse B. Rothschild, St Francisville, LA (US); Ritchie D. Priddy, St. Francisville, LA (US)

( * ) Notice: Subject to any disclaimer, the term of this patent is extended or adjusted under 35 U.S.C. 154(b) by 762 days.

(21) Appl. No.: 12/403,555

(22) Filed: Mar. 13, 2009

Related U.S. Application Data

(60) Provisional application No. 61/069,301, filed on Mar. 14, 2008.

(51) Int. Cl.
*F25D 23/12* (2006.01)

(52) U.S. Cl. ..... 62/259.3

(58) Field of Classification Search ..... 62/259.3, 62/434, 515, 476, 118, 483; 165/46, 76, 165/104.14
See application file for complete search history.

(56) References Cited

U.S. PATENT DOCUMENTS

| | | | | |
|---|---|---|---|---|
| 3,045,243 | A | 7/1962 | Lash et al. | |
| 3,289,748 | A * | 12/1966 | Jennings | 165/46 |
| 3,468,299 | A | 9/1969 | D'Amato | |
| 3,738,367 | A * | 6/1973 | Hardy | 607/104 |
| 4,271,833 | A | 6/1981 | Moretti | |
| 4,738,119 | A * | 4/1988 | Zafred | 607/104 |
| 4,915,838 | A * | 4/1990 | Bonne et al. | 210/640 |
| 4,962,761 | A * | 10/1990 | Golden | 607/104 |
| 5,113,666 | A | 5/1992 | Parrish et al. | |
| 5,255,390 | A * | 10/1993 | Gross et al. | 2/458 |
| 5,269,369 | A * | 12/1993 | Faghri | 607/104 |
| 5,289,695 | A | 3/1994 | Parrish et al. | |
| 5,415,222 | A * | 5/1995 | Colvin et al. | 165/46 |
| 5,438,707 | A * | 8/1995 | Horn | 2/457 |
| 5,533,354 | A * | 7/1996 | Pirkle | 62/259.3 |
| 5,755,275 | A * | 5/1998 | Rose et al. | 165/46 |
| 5,895,418 | A | 4/1999 | Saringer | |
| 5,938,693 | A * | 8/1999 | Carminucci | 607/104 |
| 6,027,464 | A * | 2/2000 | Dahlquist | 601/148 |
| 6,109,338 | A * | 8/2000 | Butzer | 165/46 |
| 6,238,427 | B1 * | 5/2001 | Matta | 607/104 |
| 6,260,201 | B1 * | 7/2001 | Rankin | 2/69 |
| 6,419,691 | B1 * | 7/2002 | Hanner | 607/108 |
| 6,763,671 | B1 | 7/2004 | Klett et al. | |
| 6,858,068 | B2 | 2/2005 | Smith et al. | |
| 6,957,697 | B2 | 10/2005 | Chambers | |
| 6,993,930 | B2 | 2/2006 | Blackstone | |
| 7,637,931 | B2 | 12/2009 | Heaton | |
| 2007/0095088 | A1 | 5/2007 | Isherwood et al. | |
| 2007/0136922 | A1 * | 6/2007 | Oliver et al. | 2/69 |
| 2007/0199124 | A1 * | 8/2007 | Horn | 2/69 |
| 2007/0271939 | A1 | 11/2007 | Ichigaya | |
| 2010/0235991 | A1 * | 9/2010 | Ward et al. | 5/423 |
| 2011/0107617 | A1 * | 5/2011 | Lee et al. | 34/427 |

FOREIGN PATENT DOCUMENTS

| | | | |
|---|---|---|---|
| WO | WO 99/55265 | | 11/1999 |
| WO | WO 9955265 | A1 | 11/1999 |
| WO | WO2007/047810 | A2 | 4/2007 |
| WO | WO 2007047810 | A3 | 4/2007 |

* cited by examiner

*Primary Examiner* — Mohammad Ali
(74) *Attorney, Agent, or Firm* — Mark Nowotarski

(57) ABSTRACT

A closed loop portable cooling system for a person comprises an air circulation pad, a desiccant module, an air pump module and a heat pump module. The air circulation pad is worn by the person and provides cooling air to the person's body and removes warm moist air from the person's body. Air is delivered and removed locally to evaporation chambers adjacent to the person's skin. The warm moist air removed from the evaporation chambers is dried, compressed and cooled. It is then returned to the air circulation vest. The system is a closed loop system so that outer protective garments may be worn over it.

8 Claims, 4 Drawing Sheets

MAN PORTABLE MICRO-CLIMATE

CROSS REFERENCE TO RELATED APPLICATION

This application claims priority to U.S. provisional patent application Ser. No. 61/069,301, entitled "Man Portable Micro-Climate Cooling & Heating Apparatus", and filed on Mar. 14, 2008. Said provisional patent application is incorporated herein by reference.

FIELD OF INVENTION

This invention is in the field of personal cooling and heating apparati.

COPYRIGHT NOTICE

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

BACKGROUND

Many professions require that a person be exposed to high ambient temperatures for sustained periods of time while wearing protective garments. At the same time, they must be free to move about over large distances. Hence there is a need for a portable personal cooling apparatus that does not unduly restrict a person's movements or compromise his or her ability to wear other protective garments.

An example is a fire fighter. The fire fighter must enter buildings with high ambient temperatures with protective outer garments on. The firefighter must also be free to move about the building and may have a high exertion rate. He or she may, for example, be producing 500 thermal watts of heat simply by virtue of his or her exertion. This heat needs to be dissipated to an environment that may locally have a temperature of 120 degrees F. or more and have a high humidity. Hence normal cooling of the body through evaporation of perspiration is not effective. If this heat is not dissipated, then the firefighter may suffer heat stroke.

Similarly, combat soldiers stationed in warm climates may also need to have a means for dissipating internally generated body heat when they are wearing body armor. The body armor may inhibit a soldier's normal ability to dissipate heat through evaporation.

SUMMARY OF INVENTION

The Summary of the Invention is provided as a guide to understanding the invention. It does not necessarily describe the most generic embodiment of the invention or all species of the invention disclosed herein.

A personal cooling system compatible with protective garments may comprise an air circulation pad, one or more air pumps, and optionally a desiccant, a heat pump, such as a thermoelectric cooler, and a battery power supply.

The air circulation pad may comprise one or more delivery orifices for blowing relatively cool dry air onto a person in combination with one or more local exhaust orifices for removing said air after it has absorbed heat and moisture from said person. The pad may be in the form of a vest which both directs and removes said air from the person's chest and/or back.

Means for delivering and removing air may comprise flexible tubes with holes in them. Air delivery and exhaust tubes may be located side by side within the pad. Hence both the delivery and removal of air can be directed to specific locations of a person's body, such as around the lungs and organs.

The flexible tubes should have sufficient strength so that they do not collapse when a heavy outer garment, such as body armor or a backpack, is placed over the pad. The pad overall, however, should remain flexible enough so that the person's movements or comfort are not unduly compromised.

A pump, such as a rotary vane pump, may be provided to both deliver the relatively cool dry air to the pad and remove the relatively moist warm exhaust air from the pad. Enough air should be provided to remove at least 25 thermal watts.

In hot moist environments, the cooling air system can be a closed-loop system where the exhaust air is dried and cooled and then returned to the pad. The exhaust air can be dried with a desiccant to remove moisture picked up from the person. Thus the heat removed from the person by sweat evaporation is effectively transferred to the desiccant. The temperature of the desiccant may therefore rise above the ambient and the heat transferred thereto from the person can in turn be transferred to the environment.

The dried air may then be passed through a heat pump so that it is cooled to a comfortable temperature for the person. It is then returned to the air circulation pad to begin the evaporation cycle again.

An advantage of using a single pump, or multiple pumps plumbed in parallel or series, located downstream of the desiccant is that the net air flow into and out of the cooling pad is automatically balanced. Hence the person can wear an air tight outer protective garment, such as a hazmat suit.

DETAILED DESCRIPTION OF INVENTION

Persons of ordinary skill in the art will realize that the following disclosure is illustrative only and not in any way limiting. Other embodiments of the disclosure will readily suggest themselves to such skilled persons having the benefit of this disclosure.

As used herein, the term "about" means within +/−20% of a given value.

Air Delivery and Removal

Figure 1:
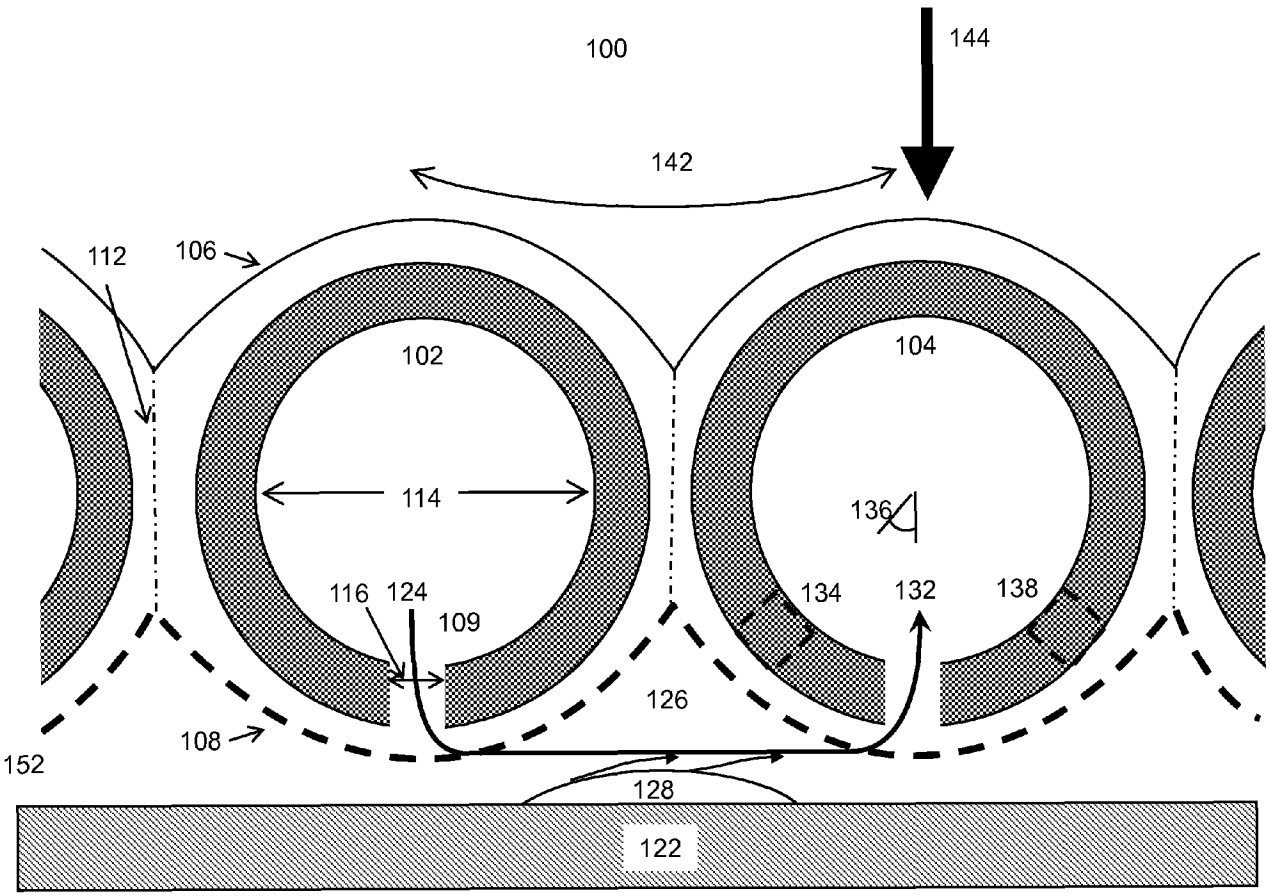
FIG. 1 is a cross section of an air circulation pad showing and air supply and exhaust tube.

FIG. 1 illustrates a cross section of a portion of an exemplary air circulation pad 100 resting on a portion of a person's skin 122. Intervening garments, such as a T shirt, may be present.

The pad comprises alternating tubes for cool dry air delivery 102 and warm moist air exhaust 104. The ID 114 of the delivery and exhaust tubes may be about ¼ inch. ⅛ to ½ inch ID are suitable.

The tubes may be made of a compliant yet firm material such as Tygon® or polyvinyl chloride (PVC).

The tubes should be firm enough to withstand heavy forces 144 from an outer heavy garment without collapsing. They should be flexible 142 enough, however, to allow for freedom of movement and comfort for the person wearing the pad.

The tubes may comprise one or more holes 109, for delivering air to the person's skin or removing said air therefrom. The diameter for the holes 116 may be 1/16 inch. A suitable range for diameters is 1/32 to 1/8 inch.

The holes may be located along the tubes at a one inch spacing. A suitable range for spacing is 1/2 to 2 inches. Different spacings on the same tubes may be appropriate depending upon the application. The spacing does not have to be uniform.

The holes may point directly at the person's skin, or they 134 may be at an angle 136 with respect to the normal vector to the skin. The angle may be 45 degrees. A suitable range for angles is 0 to 90 degrees.

Holes 134 and 138 may be provided at more than one angle on the same tube. This will help make sure that adjacent evaporation chambers 126 are purged even if a tube should be tilted off center or if some of the holes are blocked.

When the tubes are placed next to each other, evaporation chambers 126 are created therebetween. Thus in operation, cool dry air is delivered 124 to an evaporation chamber where it evaporates moisture 128 therein. The moisture may be perspiration generated locally by the person wearing the pad. Evaporation of the moisture removes heat from the skin and thus cools the person. The warm moist air is then exhausted 132 by vacuum in the exhaust tube. As described above, the warm moist exhaust air may then be dried, cooled, compressed and redelivered to the delivery tube 102 in a relatively closed loop system. By "relatively closed loop" it is meant that overall the same air is recirculated, but there may be some leakage of the recycled air to the ambient and vice versa through, inter alia, the edges of the pad 152.

A surprising advantage of the system is that relatively small flow rates of recirculated air delivered at relatively low supply pressures are effective for cooling person. A pad covering a torso, for example, might only require 16 slpm supplied at gauge pressures of 18 inches of water column. Pressures in the range of 9 to 36 inches of water column and flow rates in the range of 8 to 32 slpm are suitable.

FIG. 1 also illustrates an exemplary method of incorporating the tubes into a pad. The tubes are sandwiched between an outer relatively impermeable backing fabric 106, such as shirt fabric, and a highly permeable fabric 108, such as mosquito netting. The two fabrics are stitched together 112 between adjacent tubes so that the tubes are held firmly in place.

Other means of creating the pads are suitable, such as extruding the air delivery and exhaust tubes in a single sheet of extruded plastic with holes drilled therein by laser drilling. Evaporation chambers may also be extruded into the same sheet.

Tube Layout

Figure 2:
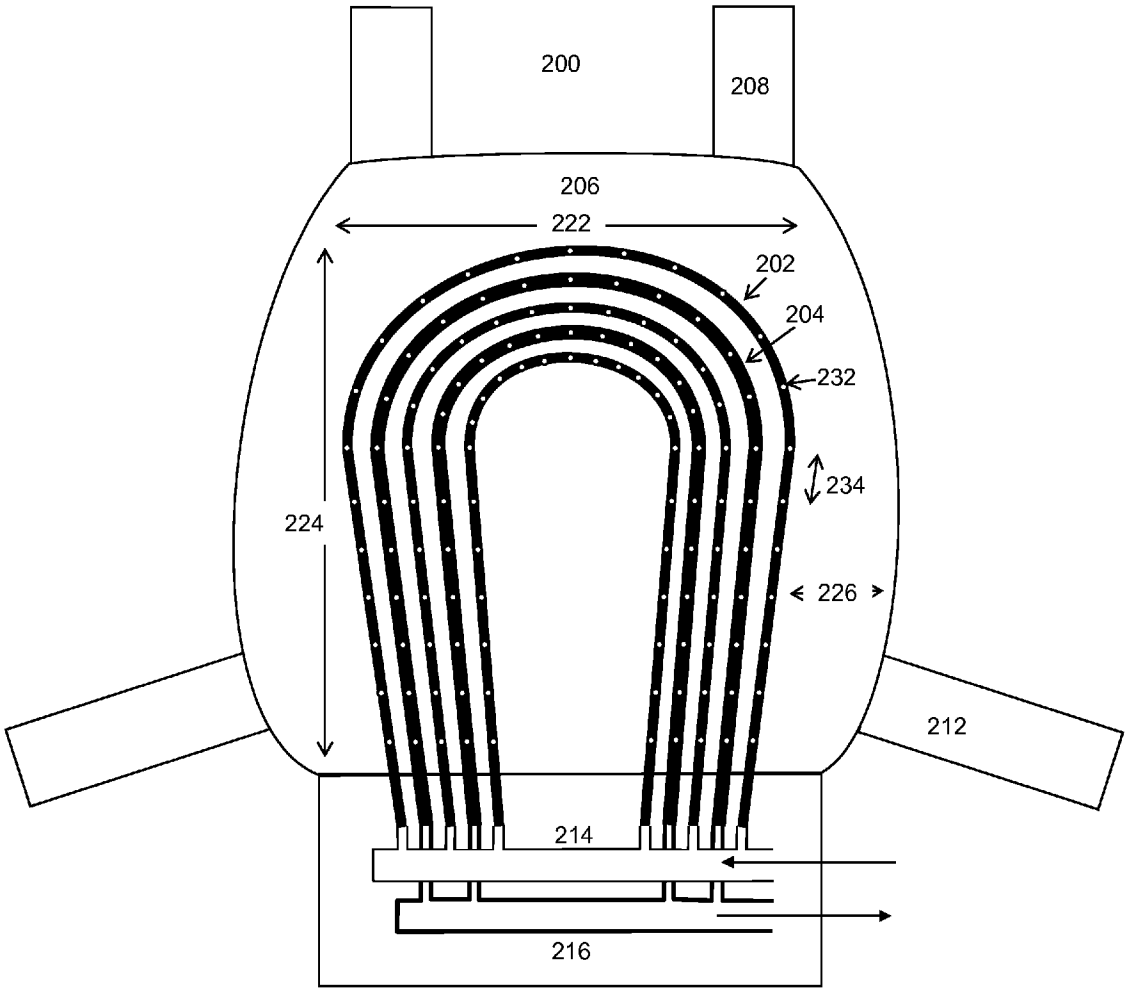
FIG. 2 illustrates a suitable configuration of air supply and exhaust tubes for a vest.

FIG. 2 illustrated how the tubes may be arranged on a pad 200 that will be worn on a person's chest or back.

Delivery tubes 202 are alternated with exhaust tubes 204 to create an arced "horseshoe" layout. Holes 232 are drilled in the tubes at a spacing 234 of about one inch. The overall width 222 of a horseshoe is about 11 inches. The overall length 224 of a horseshoe is also about 11 inches. Larger and smaller horseshoes can be laid out depending upon the size of the person or the area to be cooled. Multiple horseshoes can be located on the same pad.

The tubes are attached to a backing fabric 206 by the stitching means and mosquito netting described above. The backing fabric overhangs 226 the horseshoe by about 2 inches.

Shoulder straps 208 and waist straps 212 are provided to attach the pad to a person. A matching pad may be provided so that one pad may cool a person's back and the other pad may cool the person's front. Velcro® material may be provided to allow adjustment of the shoulder and waist straps.

A delivery header 214 may be provided to distribute cooling air to the pad. A corresponding exhaust header 216 may be provided to remove warm moist air.

Five tubes are shown in FIG. 2. Anywhere from 2 to 20 tubes, however, may be provided. The diameter of the exhaust tubes are somewhat larger than the delivery tubes since only two exhaust tubes are provided to remove the air provided by three delivery tubes.

Cooling Vest

Figure 3:
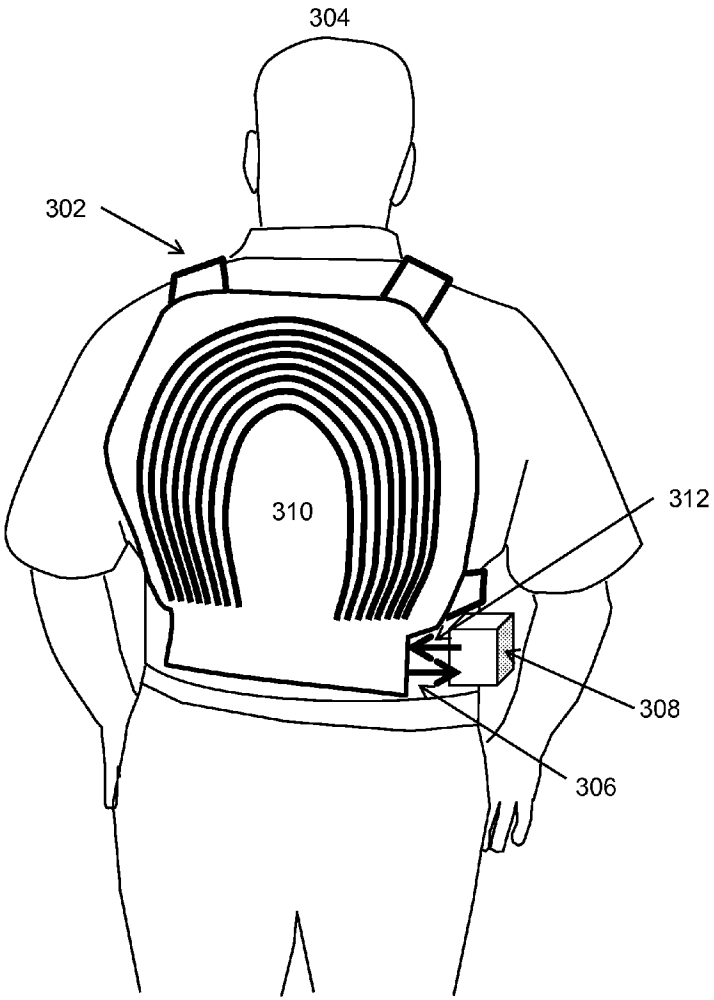
FIG. 3 illustrates how a person would wear a vest with an air circulation pad on his back.

FIG. 3 illustrates a rear view of a person 304 wearing a cooling vest 302. The cooling vest has an air circulation pad in the rear 310 and a corresponding pad in the front (not shown). Warm moist air is removed 306 from the pad, processes through a battery-powered drying and cooling module 308, and returned 312 to the pads.

Closed Loop Cooling System

Figure 4:
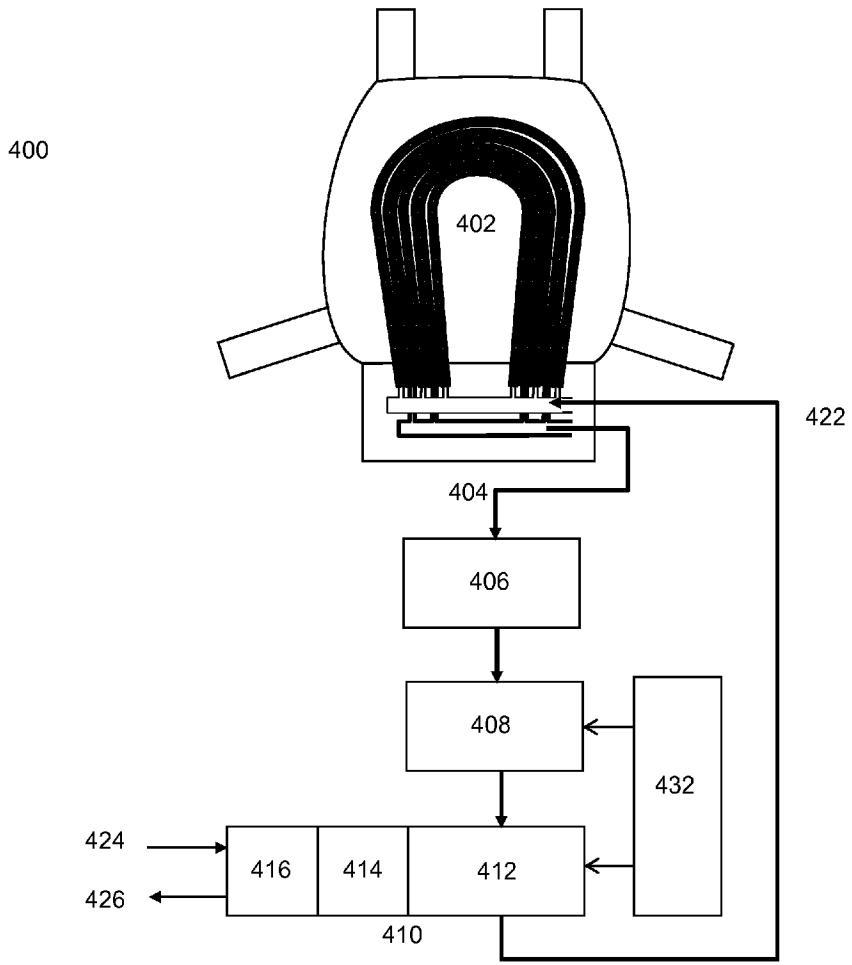
FIG. 4 illustrates a system for closed loop air recirculation drying and cooling through a pad.

FIG. 4 shows a schematic of a closed loop cooling system 400. The cooling system comprises at least one air circulation pad 402, a drying module 406, an air pump module 408, a heat pump module 410 and a battery power supply 432. The heat pump module comprises a heat pump 412, a heat exchanger 414 and a fan 416.

In operation, warm moist air is drawn from the pad and then through the drying module where a desiccant removes water. The desiccant may be silica gel, for example. The desiccant may comprise a color changing desiccant to act as an indicator of when the drying module has reached a given capacity. About 10% of the desiccant may be a color changing variety.

The dried air then passes through the pump module where its pressure is raised above ambient pressure. The compressed dried air is then cooled in the heat pump. The heat from the heat pump is dissipated to the ambient air through the heat exchanger 414 and cooled against ambient air 424, 426 circulated therethrough by the fan 416. The cooled dried pressurized air is then returned 422 to the pad where it evaporates moisture and the cycle is repeated.

Alternate Configurations

The air supply and exhaust systems may be run as open, single pass configurations. Thus outside air would be drawn in, passed through the air circulation pad and exhausted. An open, single pass configuration is suitable for environments where the wet bulb temperature is expected to be less than body temperature. Thus evaporation alone may be suitable for cooling a person. No drier and no cooler is needed in this configuration. Matched air pumps may be used for supply and exhaust.

The heat pump in the closed loop configuration may be eliminated in ambient environments where the expected ambient dry bulb temperature is below body temperature.

Thus excess sensible heat in the recirculated air may be removed by a heat exchanger alone.

Other alternative configurations may be used depending upon the specific needs of a given application. In a firefighting application, for example, where the ambient radiation temperature may be extremely high but the exposure time of the person to the environment may be relatively short, such as less than an hour, a portable ice bath may be used as a heat sink to cool and dry the recirculated air.

Alternative Applications

The systems described herein may be used in warming applications. For example a victim of hypothermia may be warmed by recirculation of warmed air through an air recirculation pad. By using a closed loop system without a desiccant, the victim will not be dehydrated by the warming.

Example

A closed recirculating air system as described above was placed on a water saturated artificial torso weighing approximately 10 kg. The air was recirculated through a back and chest air circulation pad mounted on said torso. The air flow rate was 16 slpm. The pressure boost through the rotary vane air pump was 18 inches of water column. Recirculated cooling air was dried with a color changing desiccant and chilled by 15 degrees C. in a thermoelectric cooler.

The system could maintain the torso at a core temperature of 25 degrees C. when the ambient was 32 degrees C.

CONCLUSION

While the disclosure has been described with reference to one or more different exemplary embodiments, it will be understood by those skilled in the art that various changes may be made and equivalents may be substituted for elements thereof without departing from the scope of the disclosure. In addition, many modifications may be made to adapt to a particular situation without departing from the essential scope or teachings thereof. Therefore, it is intended that the disclosure not be limited to the particular embodiment disclosed as the best mode contemplated for carrying out this disclosure.

We claim:

1. A system for cooling a person's torso, said system comprising an air circulation pad said air circulation pad comprising:

a. a fabric backing and a permeable covering;

b. a supply tube, said supply tube comprising a supply tube wall, said supply tube wall comprising a plurality of supply holes;

c. an exhaust tube, said exhaust tube comprising an exhaust tube wall, said exhaust tube wall comprising a plurality of exhaust holes;

wherein:

d. said supply tube and said exhaust tube are mounted adjacent to each other and between said fabric backing and said permeable covering such that said supply tube, said exhaust tube and said permeable covering form an evaporation chamber; and e. said supply tube holes are at least partially directed at said permeable covering.

2. The system of claim 1 which comprises:

a. a plurality of supply tubes comprising a plurality of supply tube holes; and b. a plurality of exhaust tubes comprising a plurality of exhaust tube holes;

wherein:

c. said supply tubes are connected to a delivery header;

d. said exhaust tubes are connected to an exhaust header; and e. said supply tubes alternate with said exhaust tubes such that evaporation chambers are formed therebetween.

3. The system of claim 1 which further comprises two exhaust tubes wherein said supply tube is located between said two exhaust tubes.

4. The system of claim 1 which further comprises:

a. a desiccant module;

b. an air pump module; and c. a cooling module, said cooling module comprising a heat pump;

wherein said modules are configured to:

d. dry exhaust air removed from said pad;

e. pressurize said exhaust air removed from said pad; and f. cool said exhaust air removed from said pad wherein said steps of drying, pressuring and cooling are performed in said order.

5. The system of claim 4 wherein:

a. said desiccant module comprises a color changing desiccant;

b. said pump module comprises a rotary vane pump; and c. said heat pump module comprises a thermoelectric heat pump.

6. The system of claim 1 wherein said permeable covering is an open mesh fabric.

7. The system of claim 1 which further comprises an air pump module wherein said supply tubes are connected to an outlet of said air pump module and said exhaust tubes are connected to an inlet of said air pump module.

8. The system of claim 1 which further comprises a warm air recirculation module.

* * * * *